US005299993A

United States Patent [19]

Habing

[11] Patent Number: 5,299,993

[45] Date of Patent: Apr. 5, 1994

[54] ARTICULATED LOWER BODY EXERCISER

[75] Inventor: Theodore G. Habing, Long Beach, Calif.

[73] Assignee: Pacific Fitness Corporation, Cypress, Calif.

[21] Appl. No.: 984,301

[22] Filed: Dec. 1, 1992

[51] Int. Cl.[5] ..... A63B 22/00; A63B 23/10

[52] U.S. Cl. ..... 482/52; 482/51; 482/79

[58] Field of Search ..... 482/51, 52, 53, 79, 482/80, 57

[56] References Cited

U.S. PATENT DOCUMENTS

| | | | |
|---|---|---|---|
| 3,316,898 | 5/1967 | Brown | 482/52 |
| 4,708,338 | 11/1987 | Potts | 482/52 |
| 4,949,993 | 8/1990 | Stark et al. | 482/52 |
| 5,040,786 | 8/1991 | Jou | 482/51 |
| 5,242,343 | 9/1993 | Miller | 482/52 |

OTHER PUBLICATIONS

"New Total Jagger"-The New York Times Sunday, Sep. 7, 1969 p. 29 Shopping Guide.

*Primary Examiner*—Stephen R. Crow

*Attorney, Agent, or Firm*—Blakely, Sokoloff, Taylor & Zafman

[57] ABSTRACT

An exercise machine has a pair of laterally spaced apart foot pedals, each of which is independently coupled to a frame by a respective articulated linkage. Each such linkage has a generally vertical arm that is pivotally coupled to the frame and a generally horizontal arm that is pivotally coupled to its respective foot pedal. These arms are pivotally coupled to one another such that each foot pedal is free to move with in a two-dimensional envelope of motion in a vertical plane. The linkage members are arranged so that the envelope of motion has a generally ovate shape, slightly inclined to the horizontal. The exercises performed with this apparatus may have both vertical and horizontal components of motion.

13 Claims, 2 Drawing Sheets

ARTICULATED LOWER BODY EXERCISER

BACKGROUND OF THE INVENTION

1. Field of the Invention

This invention relates generally to the field of exercise equipment, and particularly to a lower body exerciser that combines elements of both a stepping exercise and a running exercise.

2. Prior Art

A wide variety of exercise devices have been developed for exercising the various muscle groups of the human body. One class of such devices that is particularly adapted for exercising the lower body consists of cycle-type exercisers. These machines generally simulate the exercise experienced when pedaling a cycle. The operator sits in either an upright, semi-recumbent or recumbent position and operates a pair of foot pedals on a crank shaft. The operator's feet travel in a circular path, each foot constrained to move exactly out of phase with the other.

Another class of machines for exercising the lower body consists of treadmills that permit a walking or running exercise. In a treadmill exercise, there is typically no resistance other than the weight of the operator's body, the effect of which may be amplified by elevating the forward end of the treadmill.

Yet another class of lower body exercisers that has become popular in recent years, consists of machines that simulate climbing stairs. These machines typically have a pair of pedals pivotally mounted to a frame for up and down movement in a arcuate path. Operation of the pedals may be either dependent or independent. Typically, resistance is provided only for the downward stroke of each pedal so that the resulting exercise accurately simulates stair climbing.

Each of the above-mentioned classes of lower body exercisers is useful for achieving particular exercise objectives; however, each such class of exerciser is also limited by the inherent mechanical limitations on the range of motion.

SUMMARY OF THE INVENTION

One of the objects of the present invention is to provide an exercise machine that combines the benefits of the specific exercises that can be performed individually on prior art lower body exercisers.

Another object of the present invention is to provide a lower body exerciser with a range of motion heretofore unachievable with prior art exercisers.

These and other objects of the present invention are achieved in a machine having a pair of laterally spaced apart foot pedals, each of which is independently coupled to a frame by a respective articulated linkage. Each such articulated linkage has a generally vertical linkage that is pivotally coupled to the frame and a generally horizontal linkage that is pivotally coupled to its respective foot pedal. These linkages, each of which may comprise a single or a pair of linkage arms, are pivotally coupled to one another such that each foot pedal is free to move within a two-dimensional envelope of motion in a vertical plane. The linkage arms are arranged so that the envelope of motion has a generally ovate shape, slightly inclined to the horizontal. The exercise performed with this apparatus involves both vertical motion as with prior art machines that simulate stair climbing and horizontal motion as with prior art treadmills. The vertical and horizontal components of motion may each have separate resistance means. Furthermore, the rearward horizontal component of motion may be externally powered or powered solely by the operator, just as with a treadmill.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
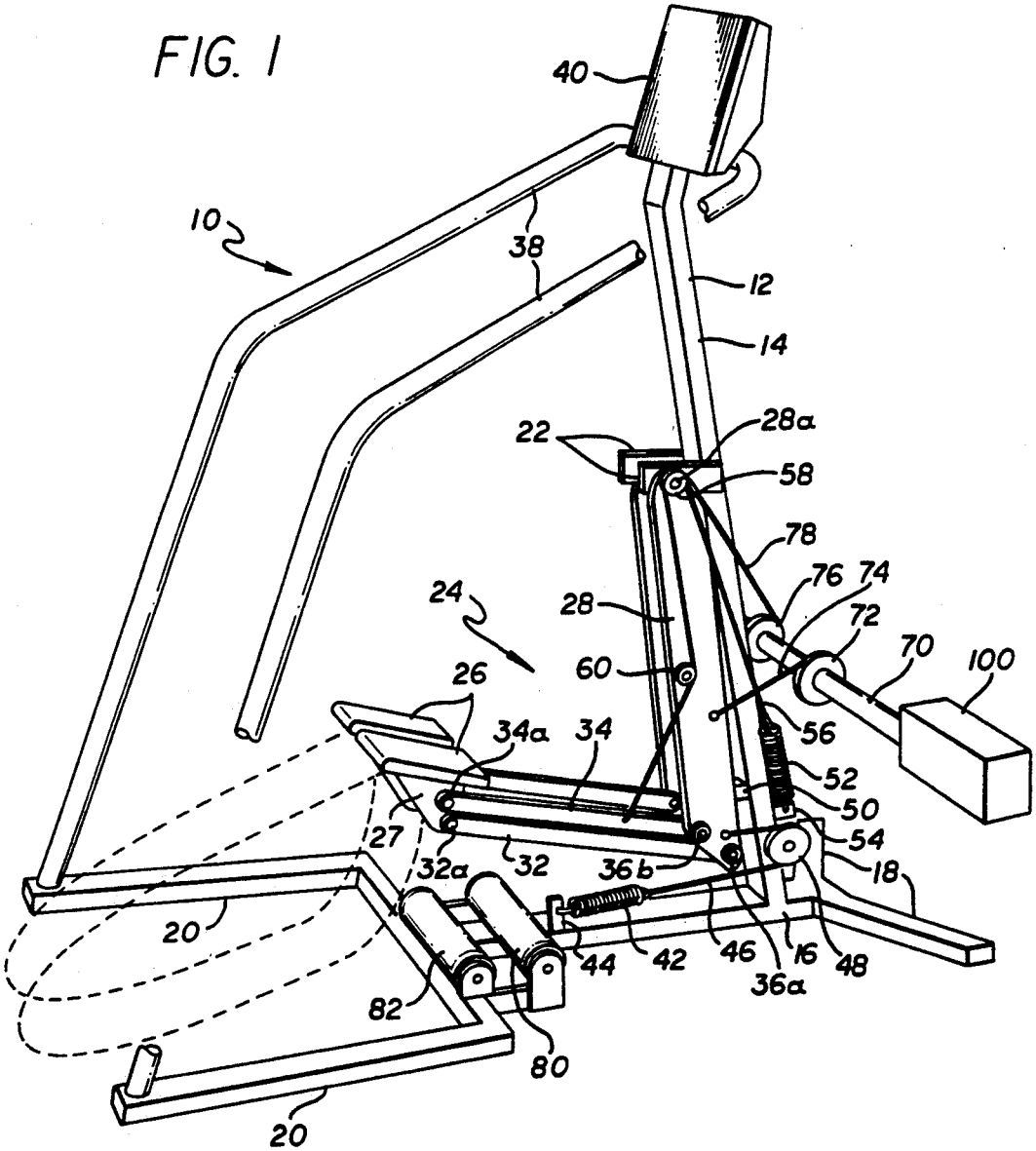
FIG. 1 is a overall perspective view of an apparatus according to the present invention.

An apparatus 10 according to the present invention is shown generally in FIG. 1. A frame 12 comprises a generally upright member 14 and a base member 16. Frame 12 is supported on a floor by front leg members 18 and rear leg members 20. Frame 12 is conveniently fabricated from square or rectangular section steel tubing as is conventional in the field of exercise equipment.

A pair of brackets 22 are welded or otherwise secured to upright member 14 at an intermediate position thereon. A pair of articulated assemblies 24 are suspended from brackets 22. Assemblies 24 are disposed on opposite sides of a longitudinal center line of frame 12. Each of articulated assemblies 24 is coupled to a respective foot pedal 26.

Each of identical articulated assemblies 24 comprises a vertical linkage arm 28, a lower horizontal linkage arm 32 and an upper horizontal linkage arm 34. Vertical linkage arm 28 is pivotally coupled to bracket 22 at pivot point 28*a*. The horizontal linkage arms 32 and 34 are pivotally coupled to vertical linkage arm 28 at pivot points 36*a* and 36*b*, respectively. Horizontal linkage arms 32 and 34 are also pivotally coupled to foot pedal bracket 27 at pivot points 32*a* and 34*a*, respectively. Lower horizontal arm 32 is preferably longer than upper horizontal arm 34 in order to progressively tilt the foot pedal through its range of motion as described below. In an alternative embodiment, a pair of vertical linkage arms may be employed so that articulated assembly 24 comprise two complete four-bar linkages. In this variation of the invention, an intermediate linkage connector is used to couple the pairs of vertical and horizontal linkage arms.

As will be more fully explained below, articulated assemblies 24 allow their respective associated foot pedals 26 to move within a two-dimensional envelope of motion in a vertical plane parallel to the longitudinal center line of frame 12. To utilize device 10, an operator stands facing upright member 14 with each foot on a respective one of foot pedals 26. Handrails 38, to be grasped by the operator for balance and support, extend from rear leg members 20 upwardly and forwardly to upright frame member 14. A display and control panel 40 houses a microprocessor-based control system for the apparatus and includes display devices for providing the operator with pertinent information regarding the exercise being performed. Panel 40 also includes input devices for selecting various exercise parameters.

Foot pedals 26 are preferably biased towards an upward and forward position which provides a convenient starting position for the exercises that may be performed utilizing apparatus 10. A spring 42 is attached to a tab 44 which in turn is secured to base member 16. A short cable 46 is attached to the opposite end of spring 42 and is reeved around pulley 48 which is rotatably mounted to upright member 14. Cable 46 is attached to vertical linkage member 28 near linkage connector 36. The length of cable 46 is such that spring 42 is maintained in tension even when vertical linkage member 28 is resting against stop 50. The characteristics of spring 42 are selected so as to provide the desired amount of forward biasing force for articulated assembly 24.

In similar manner, spring 52 provides a vertical biasing force. One end of spring 52 is attached to tab 54 which in turn is secured to upright member 14. The opposite end of spring 52 is coupled to cable 56 which is reeved over pulley 58 rotatably mounted on bracket 22 concentric with pivot point 28*a*, and then over pulley 60 which is rotatably mounted on vertical linkage member 30. Cable 56 is attached to horizontal linkage member 34. The length of cable 56 and the characteristics of spring 52 are selected so as to provide the desired amount of upward biasing force for articulated assembly 24.

It will be recognized that apparatus 10 may be used to perform exercises against the resistance afforded only by springs 42 and 52. However, it is preferred that these springs be used only to bias the foot pedals 26 into their upward and forward resting positions and that separate means 100 be provided for regulating and/or resisting movement of the articulated assemblies. Numerous resistance means suitable for use with apparatus 10 are well known in the art. In particular, various forms of electromechanical resistance have been successfully developed for use with exercise machines that simulate stair climbing. For example, U.S. Pat. No. 4,708,338 to Potts discloses a resistance system utilizing an electrical alternator and a variable load resistor to provide dynamic braking. Such a system is easily adapted for use with the present invention. Another resistance system utilizing a flywheel and friction belt is disclosed in U.S. Pat. No. 4,938,474 to Sweeney et al. This system is also easily adapted to the present invention.

The foregoing examples are not the only means for providing resistance that are suitable for use with the present invention. Indeed, virtually any device for providing resistance may be adapted for use with this invention, such as weights, springs, electromagnetic devices, etc. Furthermore, it will be recognized that the present invention may also be advantageously employed in modes that regulate or control the operator's motions rather than simply providing resistance.

Articulated assemblies 24 are coupled to the resistance means by drive shaft 70. Separate drive pulleys are provided for the vertical and horizontal linkage members. Drive pulley 72 is coupled to vertical linkage arm 28 by flexible member 74. In like manner, horizontal linkage arm 34 is coupled to drive pulley 76 by flexible member 78. Corresponding drive pulleys and flexible coupling members, although not shown, are provided for the articulated assembly on the left side of apparatus 10. Flexible members 74 and 78 may be cables, chains, belts or other transmission devices as are conventionally used in the art of exercise equipment. As illustrated in FIG. 1, apparatus 10 has a single drive shaft 70. However, it can readily be seen that separate drive shafts and separate resistance means may be provided for the respective vertical and horizontal linkage arms. In this manner, the resistance for the vertical and horizontal components of motion may be separately selected. By extension, resistance means could also be separately provided for each of the pair of articulated assemblies, although the expense and complexity of doing so would likely outweigh any benefits.

Figure 2:
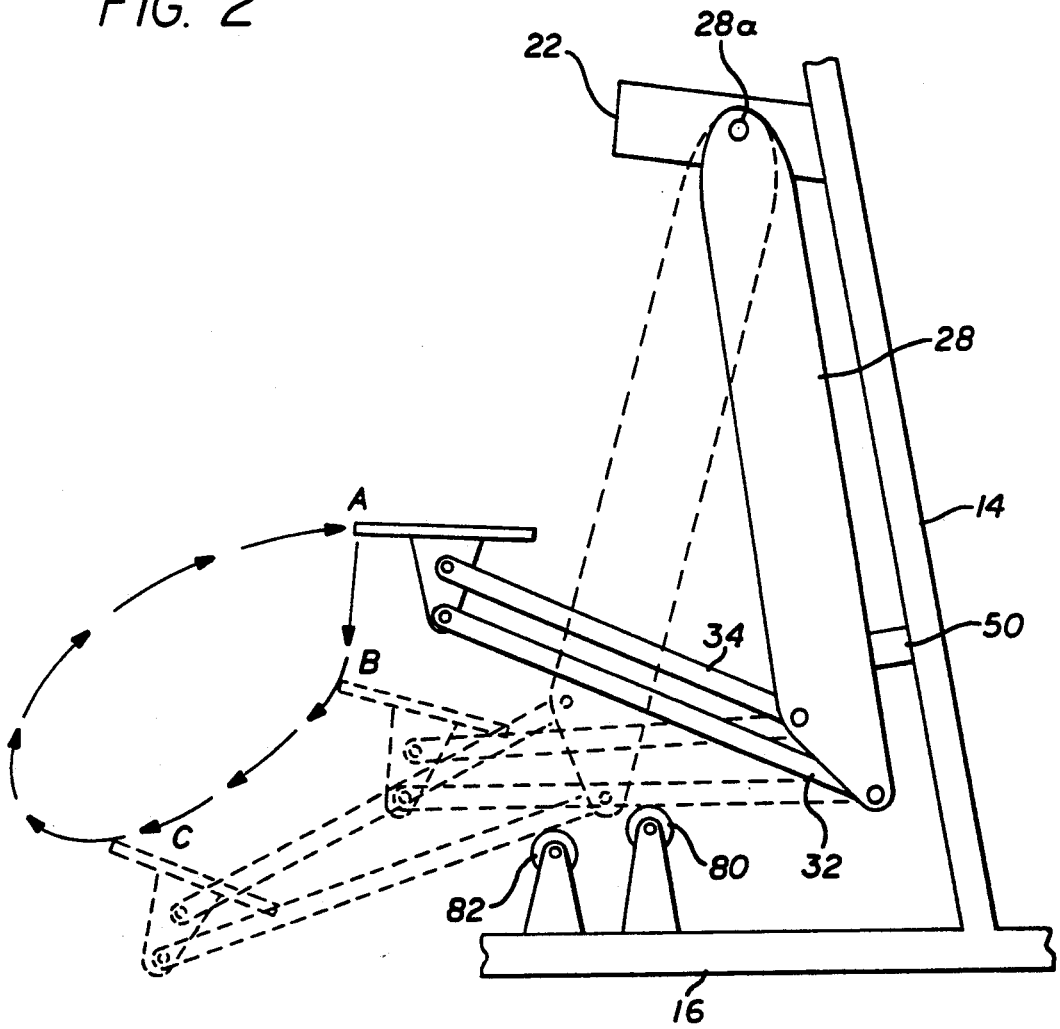
FIG. 2 diagrammatically illustrates the range of motion of the apparatus show in FIG. 1.

Referring now to FIG. 2, the path followed by one of the foot pedals 26 in the course of performing an exercise with apparatus 10 is illustrated. Position A is the rest position in which foot pedal 26 is biased to an upward and forward position by the action of springs 42 and 52 as explained above. In this position, foot pedal 26 is substantially horizontal, thereby permitting an operator to simply step up onto the foot pedals in order to perform an exercise. As the operator's weight is transferred to foot pedal 26, it begins to descend, pivoting primarily about pivot points 36*a* and 36*b* until horizontal linkage arm 32 is in contact with roller 80 as illustrated at position B. In this position, foot pedal 26 is slightly inclined. This gives the operator greater leverage for performing the optional horizontal stroke of the exercise.

From position B, the operator may simply transfer weight to the opposite foot pedal, thereby returning to position A and thus performing a simple vertical step exercise. Alternatively, from position B, the operator may push backward against foot pedal 26 to add a horizontal running stroke to the exercise. This stroke, the length of which is determined by the natural stride of the operator, terminates at position C. At this position, the inclination of foot pedal 26 has increased. From position C, the operator will naturally transfer weight to the opposite foot pedal, and the foot pedal shown in FIG. 2 will tend to return to starting position A under the influence of springs 42 and 52. The foot pedal is not constrained to follow a particular path from point C back to point A; instead, the pedal follows the natural path of the operator's foot, which is generally a smooth, curved path as illustrated.

An optional feature of the present invention is to provide a source of power, such as a D.C. motor, for roller 80 so that the horizontal stroke between positions B and C is powered, much in the manner of a treadmill. When operating in this mode, the individual expends energy to keep pace with retreating foot pedal 26, but is not applying muscular energy to force it backward as in the unpowered mode. With the option of supplying power to roller 80, it is desirable to have an unpowered idler roller 82 immediately behind roller 80 so that the terminal portion of the horizontal stroke is unpowered. This is important for safety considerations and also provides a more pleasing feel to the exercise. It will be seen that as the horizontal stroke proceeds from position B to position C, horizontal linkage member 32 "tips over" roller 80 to engage roller 82 and thereby disengage from roller 80.

It will be appreciated that apparatus 10 can be operated in a number of different modes. The operator may utilize vertical only or both vertical and horizontal components of motion. Furthermore, the resistance for each component of motion may be the same, or resistance to horizontal motion may be a predetermined percentage of the resistance to vertical motion, or each component may be separately adjusted or eliminated entirely. Also, as just discussed, the horizontal component of motion may be powered in a backward direction in the manner of a treadmill, which may be used in combination with any desired resistance to the vertical component of motion. Thus, a variety of exercises may be performed to focus on the particular needs and desires of the operator.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An exercise machine comprising:

(a) a frame;

(b) a pair of laterally spaced apart foot pedals, each pedal independently coupled to the frame by a respective articulated linkage comprising a generally vertical first linkage pivotally coupled to the frame and a generally horizontal second linkage pivotally coupled to both the first linkage and the respective foot pedal such that each foot pedal is free to travel within a two-dimensional generally ovate envelope of motion lying in a vertical plane "pedal";

(c) means coupled to the articulated linkage of each foot pedal for regulating movement thereof.

2. The exercise machine of claim 1 wherein the means for regulating movement separately regulates movement of the first and second linkages.

3. The exercise machine of claim 1 wherein the second linkage comprises a first arm and a second arm, each independently pivotally coupled to the foot pedal and the first linkage.

4. The exercise machine of claim 3 wherein the first and second linkage arms are of unequal length.

5. The exercise machine of claim 4 wherein the pivotal couplings of the first and second linkage arms are such that the foot pedal is progressively inclined as the foot pedal travels from an upper, forward position to a lower, rearward position.

6. The exercise machine of claim 1 further comprising means for biasing the foot pedals to a starting position.

7. The exercise machine of claim 6 wherein the biasing means comprises a spring.

8. The exercise machine of claim 1 further comprising first roller means for supporting the second linkage through at least a first portion of a range of motion of the first linkage.

9. The exercise machine of claim 8 wherein the first roller means is powered to propel the second linkage rearwardly within the first portion of the range of motion of the first linkage.

10. The exercise machine of claim 9 further comprising second roller means for supporting the second linkage through at least a second portion of the range of motion of the first linkage.

11. The exercise machine of claim 1 wherein the means for regulating movement comprises a drive shaft having a separate drive pulley associated with each of the first linkages and second linkages, each such linkage coupled to its respective associated drive pulley by a flexible member.

12. An exercise machine for exercising the lower body of a user comprising:

(a) a frame;

(b) a pair of laterally spaced apart foot pedals for operation by the user's feet, each pedal pivotally coupled to the frame for horizontal and vertical movement such that each foot pedal is free to travel along a path within a two-dimensional generally ovate envelope of motion lying in a vertical plane and wherein the horizontal and vertical movements of each foot pedal within its respective envelope of motion are independent;

(c) means coupled to each foot pedal for regulating movement thereof by the user; whereby the foot pedals may be operated to simulate a stair climbing or a running type motion been inserted.

13. The exercise machine of claim 12 wherein each foot pedal is coupled to the frame by a respective articulated linkage.

* * * * *